United States Patent [19]

Ramik

[11] Patent Number: 4,724,852

[45] Date of Patent: Feb. 16, 1988

[54] HAIR-STREAKING CAP

[75] Inventor: Vincent L. Ramik, Annandale, Va.

[73] Assignee: Duchess Limited, Alexandria, Va.

[21] Appl. No.: 848,203

[22] Filed: Apr. 4, 1986

[51] Int. Cl.[4] ..... A45D 19/18

[52] U.S. Cl. ..... 132/9

[58] Field of Search ..... 132/7, 9; 2/68, 174

[56] References Cited

U.S. PATENT DOCUMENTS

| | | | |
|---|---|---|---|
| 2,664,569 | 1/1954 | Andrews | 2/68 |
| 2,709,442 | 5/1955 | Willat | 132/9 |
| 2,783,806 | 3/1957 | Andreadis | 132/9 |
| 2,957,480 | 10/1960 | Widoff et al. | 132/9 |
| 3,113,319 | 12/1963 | Vail | 2/68 |
| 3,249,113 | 5/1966 | Sobeck | 132/9 |
| 3,390,689 | 7/1968 | Newman | 132/9 |
| 3,468,318 | 9/1969 | Cook et al. | 132/9 |
| 4,267,850 | 5/1981 | Barrett | 132/9 |

*Primary Examiner*—Gene Mancene
*Assistant Examiner*—Adriene J. Lepiane
*Attorney, Agent, or Firm*—Diller, Ramik & Wight

[57] ABSTRACT

A hair-streaking cap which includes a semi-hemispherical body formed of relatively resilient polymeric or copolymeric plastic material. The cap has a plurality of areas adapted to be penetrated by a hook-like implement for pulling groups of strands of hair therethrough which can be treated with a liquid. The semi-hemispherical body has on its internal surface at least one radially inwardly directed circumferential rib which projects beyond an inner semi-hemispherical surface of the body. The circumferential rib (1) prevents internal liquid leakage downwardly when the head of a person, (2) automatically increases the resilience of the semi-hemispherical body, and reduces the internal diameter to effect a relatively tight fit of the cap upon the head of a user.

5 Claims, 3 Drawing Figures

HAIR-STREAKING CAP

BACKGROUND OF THE INVENTION

It is conventional to provide hair-streaking caps of the type which include a generally semi-hemispherical body formed of relatively resilient polymeric or copolymeric plastic material, as is perhaps typified by U.S. Pat. No. 4,267,850 in the name Eileen Barrett which issued on May 19, 1981. In this patent the hair-streaking cap includes the relatively large opening in the crown through which projects the hair in a ponytail fashion. However, a similar cap is also conventional absent the large hold in the crown for tinting, streaking or otherwise treating relatively short hair, and the present invention is equally applicable to both types of hair-streaking caps.

The hair-streaking cap of U.S. Pat. No. 4,267,850 has been used for several years, and while very effective in achieving the objectives thereof, several problems were noted. Among the problems was the difficulty of accommodating a single cap size to different size heads of users. If, for example, the cap was large relative to the head size of a user and fitted loosely thereupon, there was little pain involved in pulling the groups of strands of hair through the cap by utilizing a crochet needle in a conventional fashion, but if the treating liquid found its way into the interior of the cap through the multiplicity of openings over the surface thereof, this looseness permitted the liquid to flow downwardly toward and beyond the user's forehead, ears, neck nape, etc. Obviously, such is totally undersirable as is the reciprocal of a tight cap, namely, no leakage or bleeding; yet more pain due to the tightness of the cap upon the head and hair of a user.

Incident to overcoming the latter-noted problems, the present invention also resulted in the creation of a unobvious method of altering a mold in which the hair-streaking cap is formed to effectively change its size from a large to a smaller size. Thus, while this method is predominately directed toward molding caps between a male plunger which is received in a female cavity to form a cap therebetween, it is equally applicable to virtually any article manufactured by this conventional technique.

SUMMARY OF THE INVENTION

In view of the foregoing a primary object of the present invention is to provide a novel hair-streaking cap of the type which includes a generally semi-hemispherical body formed of relatively resilient polymeric or copolymeric plastic material, the body being defined by a generally semi-hemispherical wall set-off between inner and outer semi-hemispherical surfaces, the semi-hemispherical wall being defined by a crown wall portion, a peripheral-free edge wall portion, and a generally annular wall portion therebetween, at least one of the wall portions being adapted to be penetrated by a hook-like implement for drawing groups of strands of hair therethrough which can be treated with a liquid applied thereto exteriorly of the semi-hemispherical body, the improvement includes at least on radially inwardly directed circumferential rib means projecting beyond the inner semi-hemispherical surface for (1) preventing internal leakage downwardly in a direction from the crown wall portion toward the peripheral free edge wall portion, (2) automatically increasing the resilience of the semi-hemispherical body in a circumferential area of the circumferential rib means, and (3) reducing the internal diameter of the annular wall portion at the circumferential rib means to effect a relatively tight fit of the cap upon the head of the user in the latter area while permitting ease of penetration of the hook-like element and the withdrawal of groups of strands of hair thereby in the absence of attendant pain.

Still another object of this invention is to provide a novel hair-streaking cap as aforesaid including at least one other radially inwardly directed circumferential rib means as and spaced from the latter-mentioned circumferential rib means, and the two circumferential rib means collectively defining therebetween a radially inwardly opening reservoir for receiving and housing liquid which may leak past an uppermost of the circumferential rib means when in use during liquid treatment of hair.

Still another object in this invention is to provide a novel streaking cap as heretofore set forth including a plurality of exterior annular radially outwardly projected ribs located between the circumferential rib means through which a hook-shaped implement is adapted to be inserted into the reservoir.

Still another object of this invention is to provide a novel method of decreasing the effective internal diameter of an injection-molded, compression-molded or like article of a generally cup-like configuration defined between a male plug having an outer surface and a female cavity having an inner surface with the latter surfaces being in relatively close relationship and defining a wall of the cup-shaped article, the inner concave surface of the cup-like article having a diameter established by the outer convex surface of the male plug, the method including the steps of cutting a circumferential groove into the outer surface of the male plug to a radial depth equal to one-half of that desired with respect to the original radius, thereafter molding a cup-like article in the cavity thus formed, filling the circumferential groove and creating a circumferential rib on the interior of the cup-like article and thereafter removing the cup-like article from the mold with the internal circumferential rib therein representing in the radial dimension the decrease in the size of the cup-like article as compared to an article formed in the same mold prior to the formation of the circumferential rib therein.

With the above and other objects in veiw that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 3:
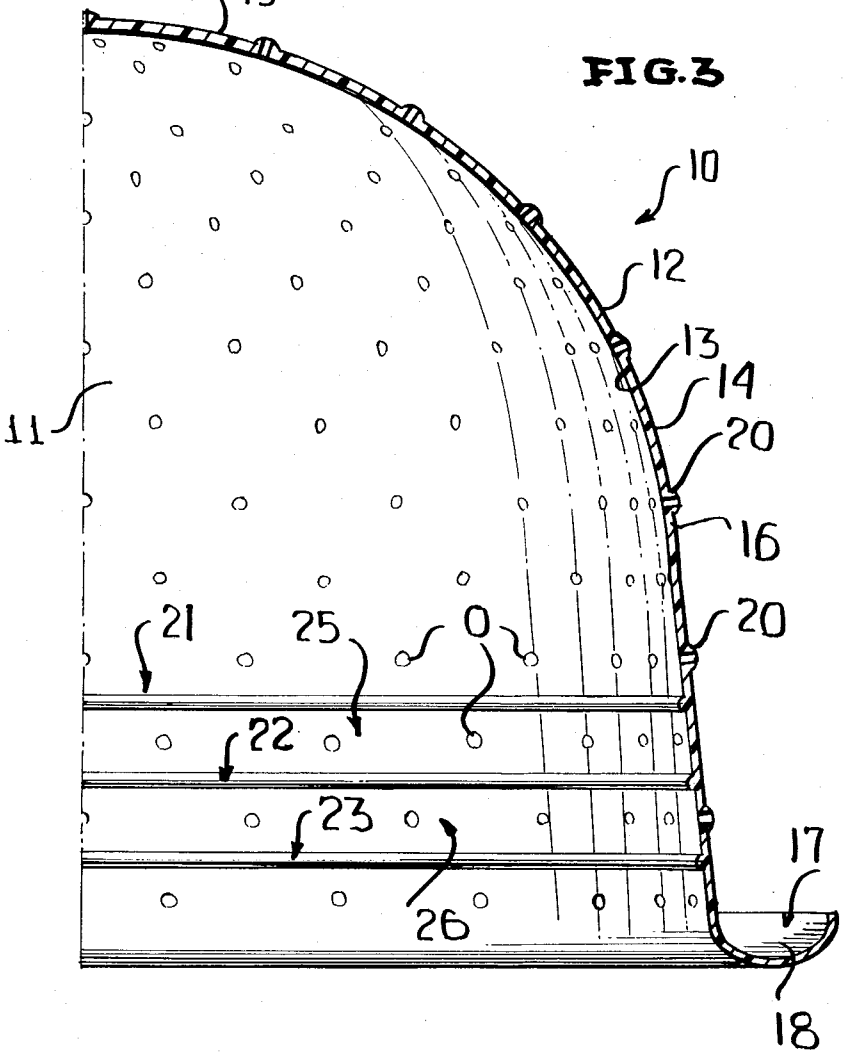
FIG. 3 is an enlarged fragmentary sectional view taken generally along line 3—3 of FIG. 2, and illustrates details of the ribs and the reservoirs therebetween.
Figure 1:
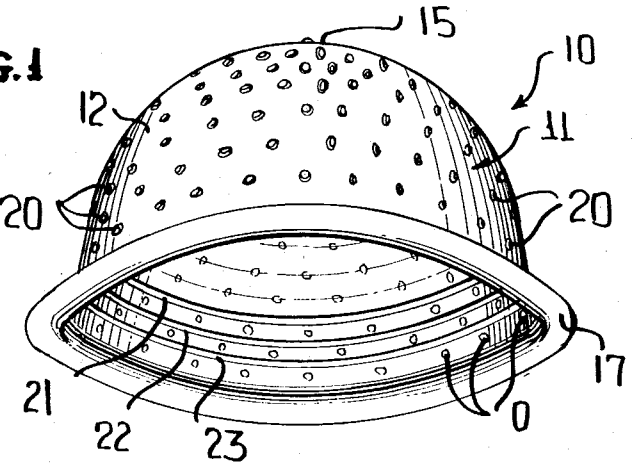
FIG. 1 is a perspective view of a novel hair-streaking cap constructed in accordance with this invention, and illustrates the generally semi-hemispherical configuration of the body, a lower peripheral brim and a plurality of internal circumferential ribs defining at least one reservoir therebetween.
Figure 2:
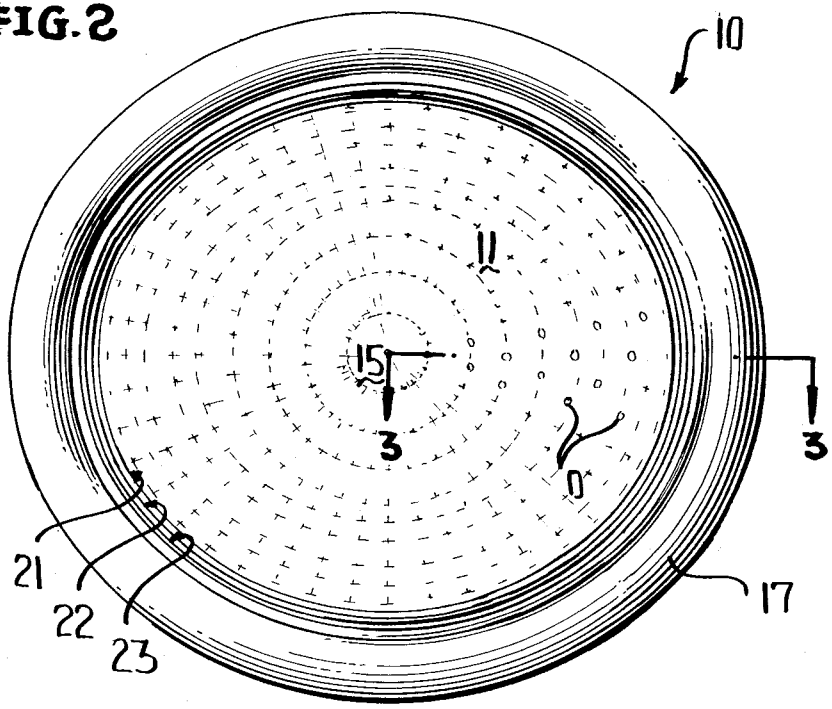
FIG. 2 is a bottom elevational view of the hair-streaking cap of FIG. 1, and illustrates a number of the internal circumferential ribs thereof.

A novel hair-streaking cap constructed in accordance with this invention is generally designated by the reference numeral 10 and includes a generally semi-hemispherical body 11. The semi-hemispherical body 11 of the hair-streaking cap 10 is formed of relatively resilient polymeric or copolymeric plastic material by injection-molding, compression-molding or the like. The semi-hemispherical body 11 is defined by a generally semi-hemispherical wall 12 set-off between inner and outer semi-hemispherical surfaces 13, 14, respectively. The semi-hemispherical wall is also generally defined by a crown or crown wall portion 15, a generally annular wall portion 16 and a peripheral free edge or wall portion 17 which is directed generally radially outwardly and upwardly (FIG. 3) to define an annular chamber 18 into which liquid can collect during a hair-treating operation.

The crown 15 does not include a large opening therein, but the same can be provided for streaking relatively long hair, but in this case the hair-streaking cap 10 is intended more for utilization during the streaking of relatively short hair.

The body 11 includes a plurality of radially directed annular located ribs 20 which are designed to locate a hook-like implement, such as a crochet needle, which penetrates the wall 12, is used to then pull groups of strands of hair therethrough in the conventional fashion, and these are then tinted, streaked or otherwise treated by a cosmetologist/hairdresser. While openings 0 are illustrated in the wall 12, these are simply slight tears or penetrations which are created when the crochet needle is pushed through the wall 12. Stated otherwise, the wall 12 is basically molded without any openings whatever therein, and those openings 0 which are formed in by the wall 12 are formed by the user of the cap by simply penetrating the wall 12 in the area of each of the annular rings 20.

The cap 10 includes at least one radially inwardly directed circumferential rib means projecting beyond the inner semi-hemispherical surface 13, but three such identical rib means are shown and are designated by the reference numerals 21, 22 and 23. The rib means 21 is uppermost, the rib means 23 is lowermost, and the rib means 22 lies approximately midway therebetween and defines with each of the rib means 21, 23 respective radially inwardly directed annular reservoirs 25, 26 within which liquid can be accumulated should it penetrate through any of the openings 0 and leak downwardly past, for example, the rib means 21. Obviously, the rib means 21 functions to prevent liquid from passing downwardly therebeyond but should such occur, it is confined within the reservoir 25 by the rib means 22. Likewise, should for some reason liquid find its way beyond the rib means 22, it should be confined within the reservoir 26 by the circumferential rib means or rib 23. Obviously, the effective diameters of the ribs or circumferential rib means 21 through 23 vary in size because of the shape of the cap, as is best viewed in FIG. 3, and essentially the overall size thereof increases from the rib 21 to the rib 22 and from the rib 22 to the rib 23. Thus, if the cap is placed upon a person with a relatively large head, there is a good possibility that all three ribs 21 through 23 will create an effective seal, while in any case when the cap 10 is placed upon a smaller head, perhaps only the ribs 21, 22 will form such a seal or perhaps only the rib 21 will come into play. However, in any case the ribs 21 through 23 effectively function for providing a liquid seal to prevent downward leakage of liquid which may have permeated into the interior of the hair-streaking cap 10 through the openings 0.

The circumferential rib means 21 through 23 are also operative for decreasing the resilience of the semi-hemispherical body in the circumferential area of each. This is simply because the cross-sectional thickness in the area of each of the circumferential ribs or rib means 21 through 23 is greater and, thus, the tendency to stretch is reduced. This reduces distortion in the area of the rib means 21 through 23 and, thus, the overall initial size of the cap 10 will be retained for a longer time.

Finally, the rib means 21 through 23 also effectively reduce the overall internal diameter of the annular wall portion 13 corresponding, of course, to the degree or extent of inward projection of the ribs 21 through 23 relative to the internal surface 13 and relative to the position of the ribs 21 through 23 axially along the internal surface 13. Considering the first of these aspects, if the cap 10 were constructed without any of the ribs 21 through 23, the internal surface 13 thereof would progressively increase in diameter from a minimum in the area of the crown wall portion 15 to a maximum in the area of the peripheral wall portion 17. Conventional hair-streaking caps are formed exactly in this fashion. The manner in which such conventional hair-streaking caps are formed is simply by forming an injection mold having a cavity corresponding in dimensions and depth to the internal surface 13 and the external surface 14. Normally, this cavity is formed by constructing a male plunger having an external generally semi-hemispherical or convex configuration corresponding to the surface 13 and forming a female cavity having an internal semi-hemispherical surface corresponding to the exterior semi-hemispherical surface 14. The plunger is inserted into the cavity, the surfaces thereof are spaced a slight distance apart, plastic material is injected into the cavity in a conventional manner, and a cap is formed to the configuration illustrated in FIG. 3, absent, once again, the ribs 21, 22 and 23. Thus, such a cap would simply have an unribbed semi-hemispherical surface 13 and when placed upon the head of the user, could result in the disadvantages heretofore noted, namely, tightness/looseness and/or pain/no pain upon hair withdrawal, etc. However, in keeping with the present invention and particularly the method of molding the cap 10, the original male plug which simply includes a semi-hemispherical outer convex surface was provided with three grooves (not shown) corresponding to mirror images of the ribs 21, 22 and 23. This plug was then associated with the same female mold cavity and the cap 20 formed therein resulting in the ribs 21, 22 and 23 which automatically decreased the overall size of the cap in the area of the three ribs, as compared to the diameter in these same areas prior to the formation of the circumferential ribs 21 through 23. These circumferential grooves in the male plug also automatically decrease the resilience of the body 11 in the circumferential area of the rib means 21 through 23, simply because of the thickening of the material thereat. This renders the cap more stable size-wise over a long period of time.

Finally, by thus reducing the overall thickness of the cap in the area of the ribs 21, 23 these ribs form a tighter fit of the cap on the head of a user, irrespective of the user's head size because one or more of the ribs 21 through 23 will come into play. That is if the user is a person who has a relatively large head, all three ribs 21, 22, and 23 should tightly bear against the user's head, whereas a smaller user's head might simply have a relatively tight fit only with respect to the smaller diameter circumferential rib 21. However, in all cases where the ribs 21 through 23 or any one thereof forms a relatively tight fit with the head of a user, this tightness is not reflected above the rib 21 and, therefore, there is a relatively loose fit between the user's head and the annular wall portion 14 above the rib 21 and the crown 15. Hence, any hair in the area above the rib 21 can be pulled outwardly through the openings 0 thereabove in a relatively painless or pain-free fashion.

In view of the foregoing, the novel hair-streaking cap achieves by the utilization of by a single rib three novel functional and structural features heretofore unprovided for by the prior art, and when two such ribs are placed in adjoining fashion, the reservoirs 25 and/or 26 are also provided to additionally accommodate for any liquid which may seep beyond either or both of the ribs 21, 22.

Although a preferred embodiment of the invention as has been specifically illustrated and described herein, it is to be understood that minor variations may be made in the apparatus without departing from the spirit and scope of the invention, as defined in the appended claims.

What is claimed is:

1. A hair-streaking cap of the type including a generally semi-hemispherical body formed of relatively resilient polymeric or copolymeric plastic material, said semi-hemispherical body being defined by a generally semi-hemispherical wall set-off between inner and outer semi-hemispherical surfaces, said semi-hemispherical wall being defined by a crown wall portion, a peripheral free edge wall portion, and a generally annular wall portion therebetween, at least one of said wall portions being adapted to be penetrated by a hook-like implement for pulling groups of strands of hair therethrough which can be treated with a liquid applied thereto exteriorly of said semi-hemispherical body, the improvement comprising at least one radially inwardly directed continuous uninterrupted circumferential rib means projecting beyond said inner semi-hemispherical surface for preventing internal liquid leakage downwardly in a direction from said crown wall portion toward said peripheral free edge wall portion, automatically decreasing the resilience of the semi-hemispherical body in a circumferential area of said circumferential rib means, reducing the internal diameter of said annular wall portion at said circumferential rib means to effect a relatively tight fit of said cap upon the head of a user, an a plurality of locating means between said circumferential rib means and said crown wall portion through which a hook-like implement is adapted to be inserted through said semi-hemispherical wall creating openings through which hair-treatment liquid can leak through into said body above said circumferential rib means.

2. The improvement in a hair-streaking cap as defined in claim 1 including at least one other radially inwardly directed continuous uninterrupted circumferential rib means generally identical to the first-mentioned circumferential rib means and spaced therefrom to define therewith a circumferentially extending radially inwardly opening reservoir for receiving and housing liquid which may have leaked past one of said circumferential rib means.

3. The improvement in a hair-streaking cap as defined in claim 2 including another plurality of locating means between said first and second mentioned circumferential rib means through which a hook-shaped implement is adapted to be inserted through said semi-hemispherical wall into said reservoir.

4. The improvement in a hair-streaking cap as defined in claim 3 including a third radially inwardly directed continuous uninterrupted circumferential rib means generally identical to said first and second mentioned circumferential rib means and defining with said second-mentioned rib means a second circumferentially radially inwardly opening liquid-receiving reservoir.

5. The improvement in a hair-streaking cap as defined in claim 4 includes a further plurality of locating means between said second-mentioned and third circumferential rib means through which a hook-shaped implement is adapted to be inserted through said semi-hemispherical wall into said second reservoir.

* * * * *